US007751757B2

(12) United States Patent
Kim et al.

(10) Patent No.: US 7,751,757 B2
(45) Date of Patent: Jul. 6, 2010

(54) DEVELOPER CARTRIDGE, DEVELOPING DEVICE AND IMAGE FORMING APPARATUS

(75) Inventors: Jin Hong Kim, Incheon (KR); Joo Hwan Noii, Yongin-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 0 days.

(21) Appl. No.: 12/147,736

(22) Filed: Jun. 27, 2008

(65) Prior Publication Data

US 2009/0097884 A1 Apr. 16, 2009

(30) Foreign Application Priority Data

Oct. 15, 2007 (KR) ..... 10-2007-0103550

(51) Int. Cl.
*G03G 15/08* (2006.01)

(52) U.S. Cl. ..... 399/254; 399/58; 399/222; 399/263

(58) Field of Classification Search ..... 399/254; 222/DIG. 1
See application file for complete search history.

(56) References Cited

U.S. PATENT DOCUMENTS

| | | | | |
|---|---|---|---|---|
| 5,748,669 | A * | 5/1998 | Yada | 375/135 |
| 7,212,773 | B2 * | 5/2007 | Sudo et al | 399/222 |
| 2008/0145112 | A1 * | 6/2008 | Bessette | 399/263 |

FOREIGN PATENT DOCUMENTS

KR 2000-19423 4/2000

* cited by examiner

*Primary Examiner*—David M Gray
*Assistant Examiner*—Roy Yi
(74) *Attorney, Agent, or Firm*—Stanzione & Kim LLP

(57) ABSTRACT

A developer cartridge constructed in a structure in which an overload is not applied to stirring units to stir a developer even when the developer is lump includes a housing having a developer storage chamber, a first stirring unit rotatably mounted in the housing, and a second stirring unit rotatably mounted in the housing such that the second stirring unit is rotatable with time delay after a rotation of the first stirring unit. The second stirring unit includes a rotary shaft, and the developer cartridge further includes a rotary member coupled to one end of the rotary shaft and a power transmission member to transmit a rotary force to the rotary member after rotation thereof by a predetermined angle.

9 Claims, 8 Drawing Sheets

DEVELOPER CARTRIDGE, DEVELOPING DEVICE AND IMAGE FORMING APPARATUS

CROSS-REFERENCE TO RELATED APPLICATIONS

This application claims priority under 35 U.S.C. §119(a) from Korean Patent Application No. 2007-103550, filed on Oct. 15, 2007 in the Korean Intellectual Property Office, the disclosure of which is incorporated herein in its entirety by reference.

BACKGROUND OF THE INVENTION

1. Field of the Invention

The present general inventive concept relates to an image forming apparatus, and, more particularly, to an image forming apparatus constructed in a structure in which an overload is not applied to stirring units to stir a developer.

2. Description of the Related Art

An image forming apparatus, such as a printer, a copier, or a facsimile, forms an image on print media according to an image signal input to the image forming apparatus. An electro-photographic image forming apparatus, a type of image forming apparatus, scans light on a photoconductor charged with a predetermined electric potential to form an electrostatic latent image on an outer circumferential surface of the photoconductor, supplies a developer to the electrostatic latent image to obtain a visible image, and transfers and fixes the visible image to print media to print the image.

A developing device of the image forming apparatus includes a developer storage chamber. The developer storage chamber may be provided in a single process cartridge together with principal components necessary for development or may be provided in a form of a cartridge separated from other principal components.

Whether the developer storage chamber is provided in the single process cartridge or in the form of the separate developer cartridge, stirring units to stir the developer are mounted in the developer storage chamber. The stirring units are rotated in the developer storage chamber to stir the developer when power from a drive source, mounted in an apparatus body of the image forming apparatus, is transmitted to the stirring units.

However, an overload may be applied to the stirring units depending upon conditions of the developer stored in the developer storage chamber. For example, the stirring units may be rotated while the developer stored in the developer storage chamber is nonuniformly distributed due to impacts or vibrations during transportation of the process cartridge or the developer cartridge, or the developer is lump due to high humidity.

When an overload is applied to the stirring units in the above-mentioned situation, the stirring units may be damaged, or a motor to drive the stirring units may break, with the result that properly stirring or feeding the developer is not possible.

SUMMARY OF THE INVENTION

The present general inventive concept provides a developer cartridge constructed in a structure in which an overload is not applied to stirring units to stir a developer even when the developer is lump, a developing device, and an image forming apparatus including the same.

Additional aspects and utilities of the present general inventive concept will be set forth in part in the description which follows and, in part, will be obvious from the description, or may be learned by practice of the general inventive concept.

The foregoing and/or other aspects and utilities of the general inventive concept may be achieved by providing a developer cartridge usable with an image forming apparatus, the developer cartridge including a housing having a developer storage chamber, a first stirring unit rotatably mounted in the housing, and a second stirring unit rotatably mounted in the housing such that the second stirring unit is rotatable with a time delay after a rotation of the first stirring unit.

The second stirring unit may include a rotary shaft, and the developer cartridge further include a rotary member coupled to one end of the rotary shaft and a power transmission member to transmit a rotary force to the rotary member after the rotation thereof by a predetermined angle.

The rotary member and the power transmission member may be coaxially coupled to each other.

The power transmission member may include a catching portion to transmit power to the rotary member, and the rotary member may include an interference portion interfering with the catching portion.

The rotary member and the power transmission member may have position locating portions to adjust relative positions between the rotary member and the power transmission member when the rotary member and the power transmission member are coupled to each other.

The rotary member may include an elastic piece formed at one side of the edge thereof, and the power transmission member may include a coupling groove, in which the elastic piece is fitted.

The developer storage chamber may include a developer discharge portion through which a developer is discharged, and the first stirring unit may be disposed nearer to the developer discharge portion than the second stirring unit.

The first stirring unit and the second stirring unit may be driven by a single drive source.

The foregoing and/or other aspects and utilities of the general inventive concept may also be achieved by providing a developing device usable with an image forming apparatus, the developing device including a developer storage chamber, a first stirring unit and a second stirring unit to stir a developer in the developer storage chamber, and a power transmission unit to transmit a rotary force to the first stirring unit and the second stirring unit, wherein the power transmission unit includes a rotary member to transmit a rotary force to the second stirring unit and a power transmission member to transmit power to the first stirring unit and the rotary member, the power transmission member transmitting the power to the rotary member after idling thereof by a predetermined angle relative to the rotary member.

The second stirring unit may include a rotary shaft, the rotary member is coaxially coupled to one end of the rotary shaft, and the power transmission member is rotatably coupled to the rotary member.

The power transmission unit may further include a power transmission gear to transmit power to the first stirring unit, and the power transmission member includes a gear portion to transmit power to the power transmission gear and a receiving portion to receive the rotary member.

The power transmission member may further include a catching protrusion formed in the receiving portion, and the rotary member includes an interference protrusion to interfere with the catching protrusion after the rotation of the power transmission member by the predetermined angle.

The rotary member may include a first position locating hole, and the power transmission member includes a second position locating hole corresponding to the first position locating hole.

The foregoing and/or other aspects and utilities of the general inventive concept may also be achieved by providing an image forming apparatus including a developer storage chamber, a first stirring unit and a second stirring unit to stir a developer in the developer storage chamber, a drive source to drive the first stirring unit and the second stirring unit, a power transmission gear to transmit power to the first stirring unit, a rotary member to transmit power to the second stirring unit, and a power transmission member to transmit power from the drive source to the power transmission gear and the rotary member with time delay.

The rotary member and the power transmission member may be coaxially coupled to each other, the power transmission member includes a catching protrusion to transmit power to the rotary member, and the rotary member includes an interference protrusion spaced apart from the catching protrusion in the rotation direction of the power transmission member.

The rotary member may include a first position locating hole and an elastic piece having a hook, and the power transmission member includes a second position locating hole and a coupling groove, in which the hook of the elastic piece is fitted when the second position locating hole is aligned with the first position locating hole.

The foregoing and/or other aspects and utilities of the general inventive concept may also be achieved by providing a developer cartridge usable with an image forming apparatus, the developer cartridge including a plurality of stirring units to stir developer, wherein at least one of the stirring units stirs the developer after an other of the stirrer units initiates the stirring of the developer.

The foregoing and/or other aspects and utilities of the general inventive concept may also be achieved by providing a method of stirring developer in an image forming apparatus, the method including stirring developer by one or more stirring units at a first time to reduce a load on a subsequent stirring unit, and stirring the developer at a second time by the subsequent stirring unit which is after the first time.

The foregoing and/or other aspects and utilities of the general inventive concept may also be achieved by providing a computer-readable recording medium having embodied thereon a computer program to execute a method, wherein the method includes stirring developer by one or more stirring units at a first time to reduce a load on a subsequent stirring unit, and stirring the developer at a second time by the subsequent stirring unit which is after the first time.

BRIEF DESCRIPTION OF THE DRAWINGS

These and/or other aspects and utilities of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
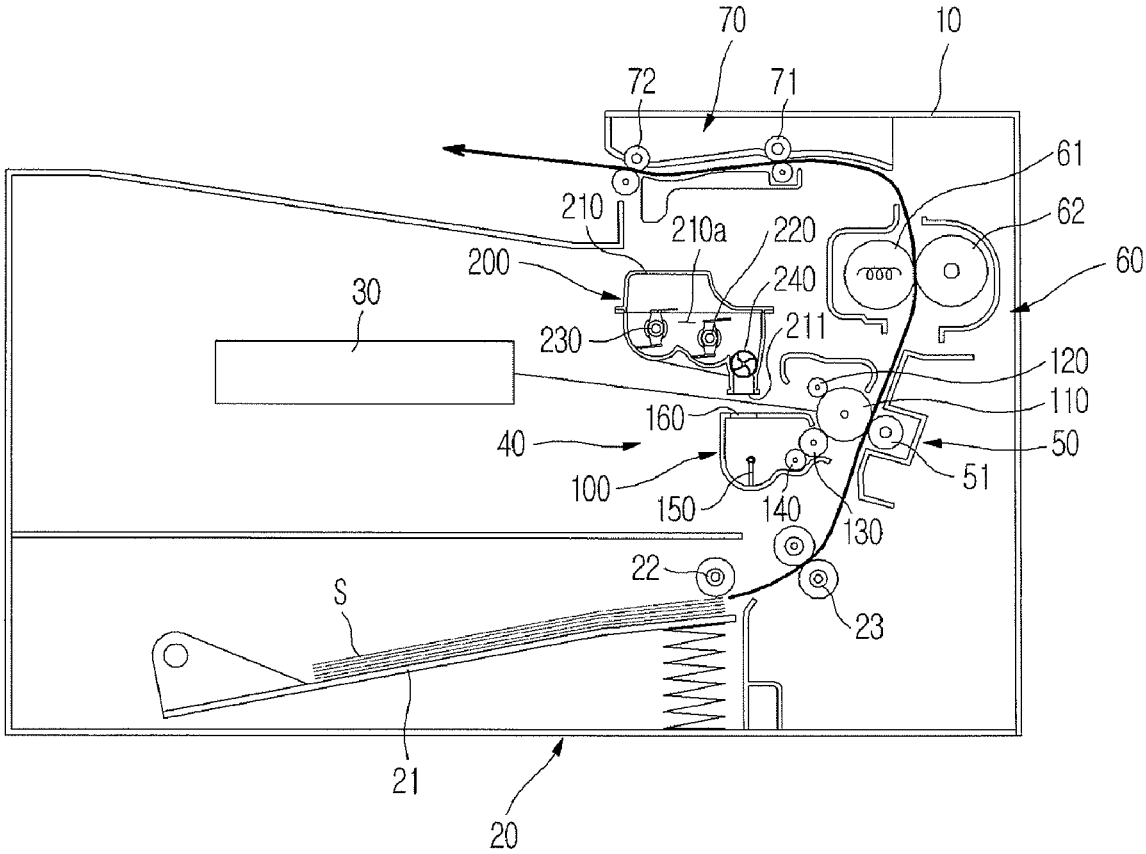
FIG. 1 is a sectional view illustrating a structure of an image forming apparatus according to an embodiment of the present general inventive concept.

Reference will now be made in detail to embodiment of the present general inventive concept, examples of which are illustrated in the accompanying drawings, wherein like reference numerals refer to like elements throughout. The embodiment is described below to explain the present general inventive concept by referring to the figures.

FIG. 1 is a sectional view illustrating a structure of an image forming apparatus according to an embodiment of the present general inventive concept.

As illustrated in FIG. 1, the image forming apparatus includes an apparatus body 10, forming an external appearance of the image forming apparatus, to support various components mounted therein. In the apparatus body 10 are mounted a paper feeding device 20, a light scanning device 30, a developing device 40, a transferring device 50, a fixing device 60, and a paper discharging device 70.

The paper feeding device 20 feeds a printing media such as paper S to the developing device 40. The paper feeding device 20 includes a feed tray 21 on which the paper S is loaded, a pickup roller 22 to pick up the paper S loaded on the feed tray 21 one by one, and a feed roller 23 to feed the paper picked up by the pickup roller 22 to the developing device 40.

The developing device 40 includes a developing unit 100 and a developer cartridge 200. The developing unit 100, including principal components to perform a developing process, develops an electrostatic latent image formed on a photoconductor 110 into a visible image. The developer cartridge 200 stores a developer to be supplied to the developing unit 100. When the developer stored in the developer cartridge 200 is completely consumed, a user may replace only the used developer cartridge 200 with a new one separately from the developing unit 100. The structure of the developer cartridge 200 will be described below in detail.

In the developing unit 100 are mounted the photoconductor 110, a charge roller 120, a development roller 130, a supply roller 140, and a developer feeding body 150. The charge roller 120 charges a surface of the photoconductor 110 with predetermined electric potential. When the light scanning device 30 scans light corresponding to image information on the surface of the photoconductor 110 charged with the predetermined electric potential, an electrostatic latent image is formed on the surface of the photoconductor 110.

The developer feeding body 150 feeds the developer, supplied from the developer cartridge 200, to the supply roller 140. The supply roller 140 supplies the developer to the development roller 130. The development roller 130 supplies the developer to the surface of the photoconductor 110, on which the electrostatic latent image is formed, such that the electrostatic latent image is developed into a visible image.

The transferring device 50 transfers the visible image, formed on the photoconductor 110, to paper S. The transferring device 50 may include a transfer roller 51 mounted at the apparatus body 10 such that the transfer roller 51 is opposite to the photoconductor 110. The transfer roller 51 presses the paper S toward the photoconductor 110 such that the visible image, formed on the surface of the photoconductor 110, is transferred to the paper S.

The fixing device 60 fixes to the paper S the image, transferred to the paper S. The fixing device 60 includes a heat roller 61 having a heat source mounted therein, a press roller 62 to press against the heat roller 61 with predetermined pressure. When the paper S passes between the heat roller 61 and the press roller 62, the image is fixed to the paper S by the heat transmitted from the heat roller 61 and the pressure acting between the heat roller 61 and the press roller 62.

The paper discharging device 70, including a first discharge roller 71 and a second discharge roller 72, discharges the paper S, having passed through the fixing device 60, out of the apparatus body 10.

Figure 2:
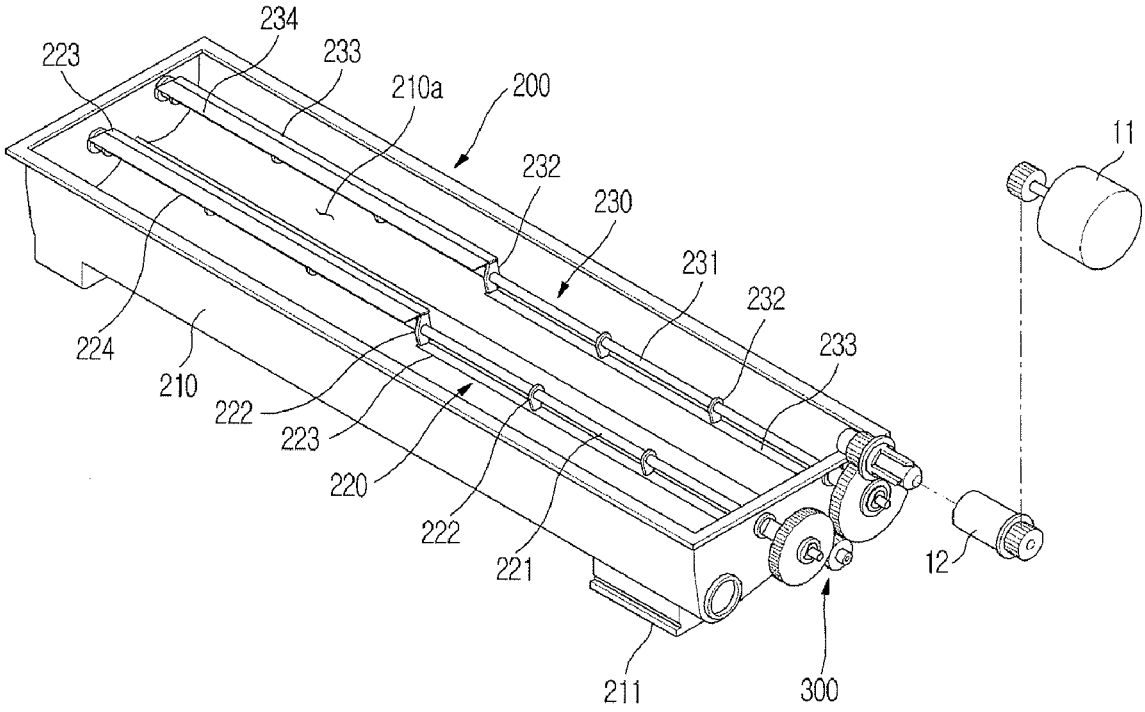
FIG. 2 is a perspective view illustrating a structure of a developer cartridge according to an embodiment of the present general inventive concept.
Figure 3:
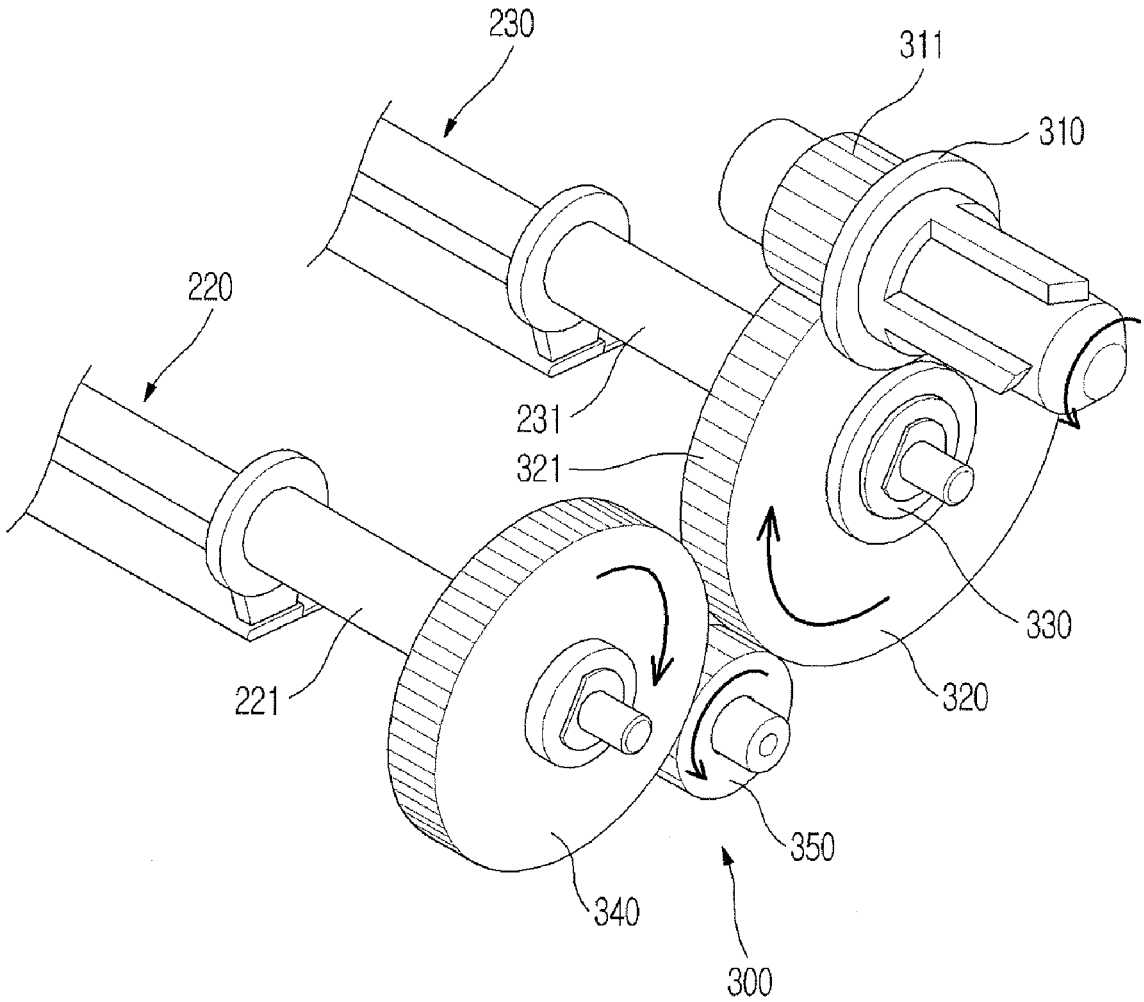
FIG. 3 is a partially enlarged view of FIG. 2.

FIG. 2 is a perspective view illustrating a structure of the developer cartridge according to an embodiment of the present general inventive concept, and FIG. 3 is a partially enlarged view of FIG. 2.

As illustrated in FIGS. 1 and 2, the developer cartridge 200 includes a housing 210 having a developer storage chamber 210*a* defined therein. At one side of the developer storage chamber 210*a* is formed a developer discharge portion 211 to supply the developer to a developer introduction portion 160 of the developing unit 100.

The developer cartridge 200 further includes a first stirring unit 220 and a second stirring unit 230 to stir the developer in the developer storage chamber 210*a* and a feeding unit 240 (see FIG. 1) to feed the developer to the developer discharge portion 211. For convenience, the feeding unit 240 is omitted from FIG. 2. The second stirring unit 230 stirs the developer therearound, and, at a same time, feeds the developer to the first stirring unit 220. Similarly, the first stirring unit 220 stirs the developer therearound, and, at a same time, feeds the developer to the feeding unit 240. The developer around the feeding unit 240 is fed to the developer discharge portion 211 by the feeding unit 240, and is then discharged into the developer introduction portion 160 of the developing unit 100.

The first and second stirring units 220 and 230 have rotary shafts 221 and 231, respectively. The first and second stirring units 220 and 230 are rotatably mounted in the housing 210. One end of the rotary shaft 221 of the first stirring unit 220 and one end of the rotary shaft 231 of the second stirring unit 230 extend through a side of the housing 210.

The first stirring unit 220 has a plurality of extension ribs 222 to extend from the rotary shaft 221 thereof in a radial direction of the rotary shaft 221. The extension ribs 222 are arranged at predetermined intervals in an axial direction of the rotary shaft 221. Some of the extension ribs 222 extend from the rotary shaft 221 in a first direction, and some of the extension ribs 222 extend from the rotary shaft 221 in a direction opposite to the first direction. Connection ribs 223, extending in the axial direction of the rotary shaft 221, are disposed at the corresponding ends of the extension ribs 222. To the connection ribs 223 are attached stirring films 224 to effectively stir the developer. Similarly, the second stirring unit 230 includes a plurality of extension ribs 232, connection ribs 233 disposed at corresponding ends of the extension ribs 232 such that the connection ribs 233 extend in the axial direction of the rotary shaft 231, and stirring films 234 attached to the connection ribs 233.

The developer cartridge 200 further includes a power transmission unit 300 to transmit a rotary force to the first stirring unit 220 and the second stirring unit 230. According to the present embodiment, the power transmission unit 300 is configured to rotate the first stirring unit 220 and the second stirring unit 230 with time delay. Specifically, the power transmission unit 300 transmits power to the first stirring unit 220 to primarily rotate the first stirring unit 220, and, after a lapse of a predetermined period of time, transmits power to the second stirring unit 230 to rotate the second stirring unit 230.

When the first stirring unit 220 and the second stirring unit 230 are rotated with time delay as described above, the second stirring unit 230 starts to be rotated after a developer lumping phenomenon is partially solved by the first stirring unit 220. Consequently, a load applied to the first stirring unit 220 and the second stirring unit 230 is lowered as compared to when the first stirring unit 220 and the second stirring unit 230 are rotated simultaneously.

When the stirring operation is initiated with the developer being lump, a greatest load is applied to the stirring units. At this time, when the first stirring unit 220 and the second stirring unit 230 are rotated simultaneously, a great load is applied to the two stirring units at a time by the lump developer. However, when the second stirring unit 230 is rotated after the developer lumping phenomenon is partially solved by primary rotation of the first stirring unit 220, a great load is not applied to the second stirring unit 230. Consequently, an excessive load is prevented from being applied overall to the first stirring unit 220 and the second stirring unit 230.

In the apparatus body 10 of the image forming apparatus are mounted a drive source 11 to drive the first stirring unit 220 and the second stirring unit 230, and a driving coupler 12 connected to the drive source 11 via a gear train (not illustrated).

As illustrated in FIGS. 2 and 3, the power transmission unit 300 includes a driven coupler 310 coupled to the driving coupler 12 when the developer cartridge 200 is mounted in the apparatus body 10, a power transmission member 320 rotatable by the power transmitted from the driven coupler 310, a rotary member 330 to transmit the power from the power transmission member 320 to the second stirring unit 230, and a power transmission gear 340 to transmit the power from the power transmission member 320 to the first stirring unit 220.

The power transmission gear 340 is coaxially coupled to one end of the rotary shaft 221 of the first stirring unit 220. The power transmission gear 340 engages with a connection gear 350, which engages with a gear portion 321 of the power transmission member 320. The gear portion 321 of the power transmission member 320 engages with a gear portion 311 of the driven coupler 310. Consequently, when the driven coupler 310 is rotated, the power transmission member 320 also rotates, and the rotary force of the power transmission member 320 is transmitted to the power transmission gear 340 via the connection gear 350.

Figure 4:
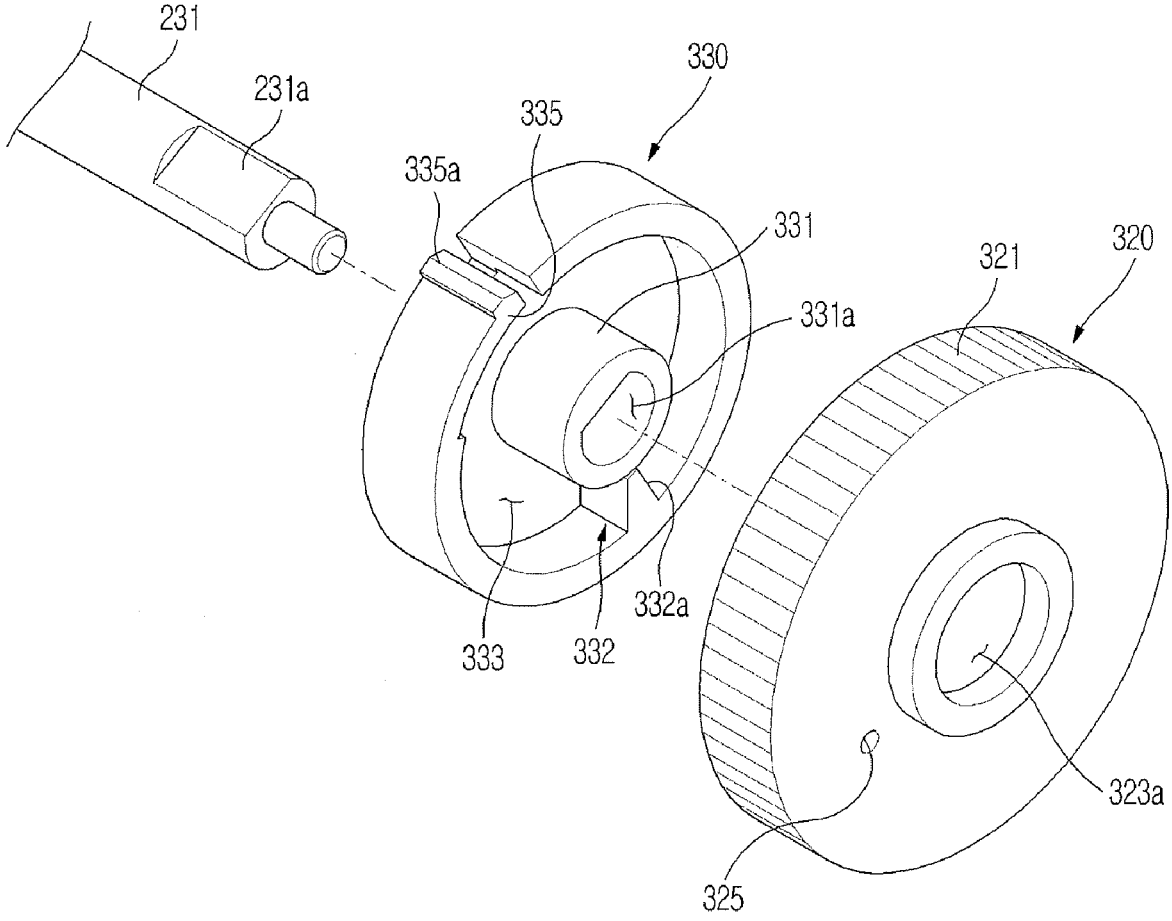
FIGS. 4 and 5 are front and rear perspective views illustrating coupling between a rotary shaft, a rotary member, and a power transmission member of a second stirring unit of an embodiment of the present general inventive concept.
Figure 5:
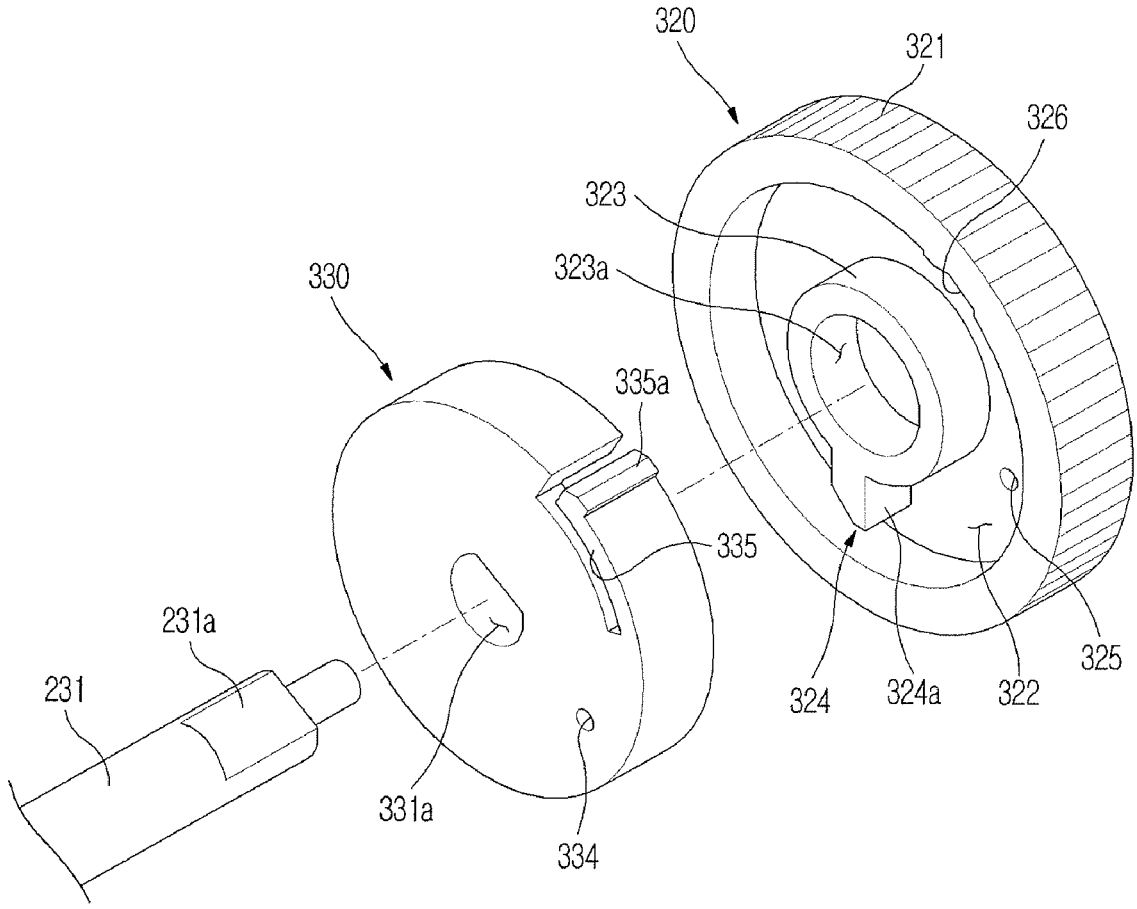
Figure 6:
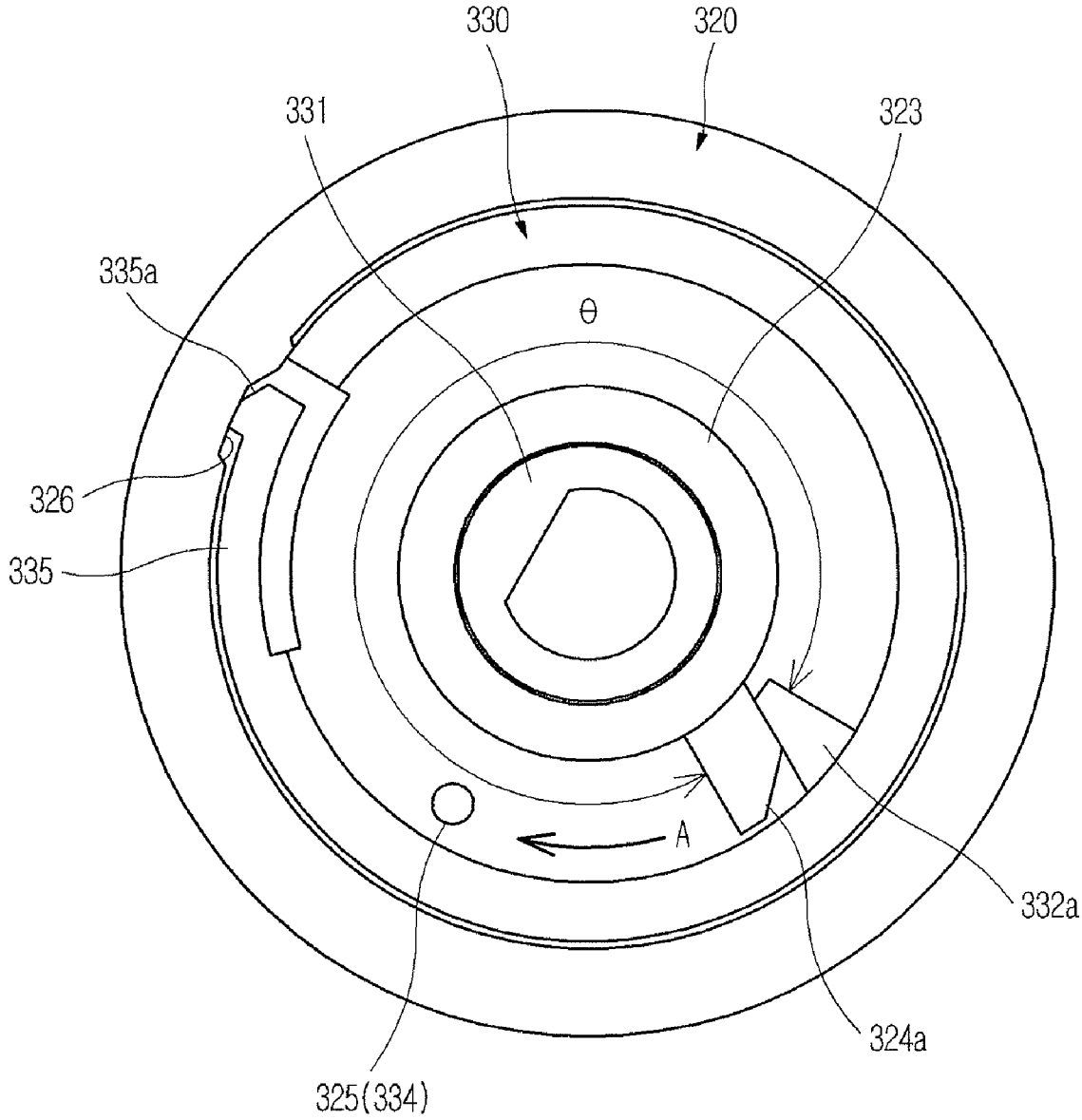
FIG. 6 is a view illustrating a positional relationship between a rotary member and a power transmission member before the rotary member and the power transmission member are driven of an embodiment of the present general inventive concept.

FIGS. 4 and 5 are front and rear perspective views illustrating the coupling between the rotary shaft, the rotary member, and the power transmission member of the second stirring unit of an embodiment of the present general inventive concept, and FIG. 6 is a view illustrating a positional relationship between the rotary member and the power transmission member before the rotary member and the power transmission member are driven of an embodiment of the present general inventive concept.

As illustrated in FIGS. 4 and 5, the rotary member 330 is coaxially coupled to the rotary shaft 231 of the second stirring unit 230, and the power transmission member 320 is rotatably coupled to the rotary member 330.

At one end of the rotary shaft 231 of the second stirring unit 230 is formed a cut portion 231*a*. The rotary member 330 is provided with a coupling boss 331 having a shaft coupling hole 331*a*, which is coupled with the cut portion 231*a*. The power transmission member 320 has a receiving portion 322, coaxially coupled to the rotary member 330, to receive the rotary member 330. At the center of the receiving portion 322 is disposed a boss receiving portion 323 protruding toward the rotary member 330. The boss receiving portion 323 has a boss insertion hole 323*a*, into which the coupling boss 331 is inserted, and therefore, the power transmission member 320 is rotatably coupled to the rotary member 330.

The power transmission member 320 has a catching portion 324 to transmit power to the rotary member 330, and the rotary member 330 has an interference portion 332 to interfere with the catching portion 324. Before the power transmission member 320 and the rotary member 330 are initially driven, the catching portion 324 of the power transmission member 320 and the interference portion 332 of the rotary member 330 are spaced apart from each other in a rotation direction of the power transmission member 320 (in the direction indicated by an arrow A of FIG. 6). That is, the catching portion 324 of the power transmission member 320 is rotated a predetermined angle, and is then located at a position where the interference portion 332 of the rotary member 330 interferes with the catching portion 324. Consequently, when the power transmission member 320 is rotated, the power is not transmitted to the rotary member 330 for a predetermined period of time.

The catching portion 324 of the power transmission member 320 may include a catching protrusion 324*a* protruding from an outer circumference of the boss receiving portion 323 in the radial direction. The rotary member 330 has a receiving groove 333 recessed inward to receive the catching protrusion 324*a*. The interference portion 332 of the rotary member 330 may include an interference protrusion 332*a* protruding from the inner circumference of the receiving groove 333 toward the coupling boss 331.

Also, as illustrated in FIGS. 4 to 6, the power transmission member 320 and the rotary member 330 have position locating portions acting as reference points for correct coupling between the power transmission member 320 and the rotary member 330 when the power transmission member 320 and the rotary member 330 are coupled to each other. The position locating portions allow, for example, an engineer, who couples the power transmission member 320 to the rotary member 330, to confirm the relative positions between the rotary member 330 and the power transmission member 320 and thus correctly couple the power transmission member 320 to the rotary member 330.

The position locating portion of the rotary member 330 may be a position locating hole 334 formed through the rotary member 330 in the axial direction, and the position locating portion of the power transmission member 320 may be a position locating hole 325 formed through the power transmission member 320 in the axial direction at a position corresponding to the position locating hole 334.

When the engineer locates the power transmission member 320 such that the position locating hole 325 of the power transmission member 320 is aligned with the position locating hole 334 of the rotary member 330, and then couples the power transmission member 320 to the rotary member 330, the catching protrusion 324*a* of the power transmission member 320 and the interference protrusion 332*a* of the rotary member 330 are located as illustrated in FIG. 6.

Also, the rotary member 330 is provided at one side of an edge thereof with an elastic piece 335, and the power transmission member 320 is provided at one side of an inner circumference thereof with a coupling groove 326 corresponding to the elastic piece 335. The elastic piece 335 is formed by cutting the one side of the edge of the rotary member 330. At the free end of the elastic piece 335 is formed a hook 335*a* protruding from the outer circumference of the rotary member 330 in the radial direction.

When the power transmission member 320 is coupled to the rotary member 330 as illustrated in FIG. 6, the hook 335*a* of the rotary member 330 is fitted in the coupling groove 326 of the power transmission member 320, free rotation of the power transmission member 320 is restrained. The process to fix the power transmission member 320 to the rotary member 330 using the elastic piece 335 and the coupling groove 326 is performed to prevent change of the relative coupling relationship between the power transmission member 320 and the rotary member 330 during distribution of the developer cartridge.

Figure 7:
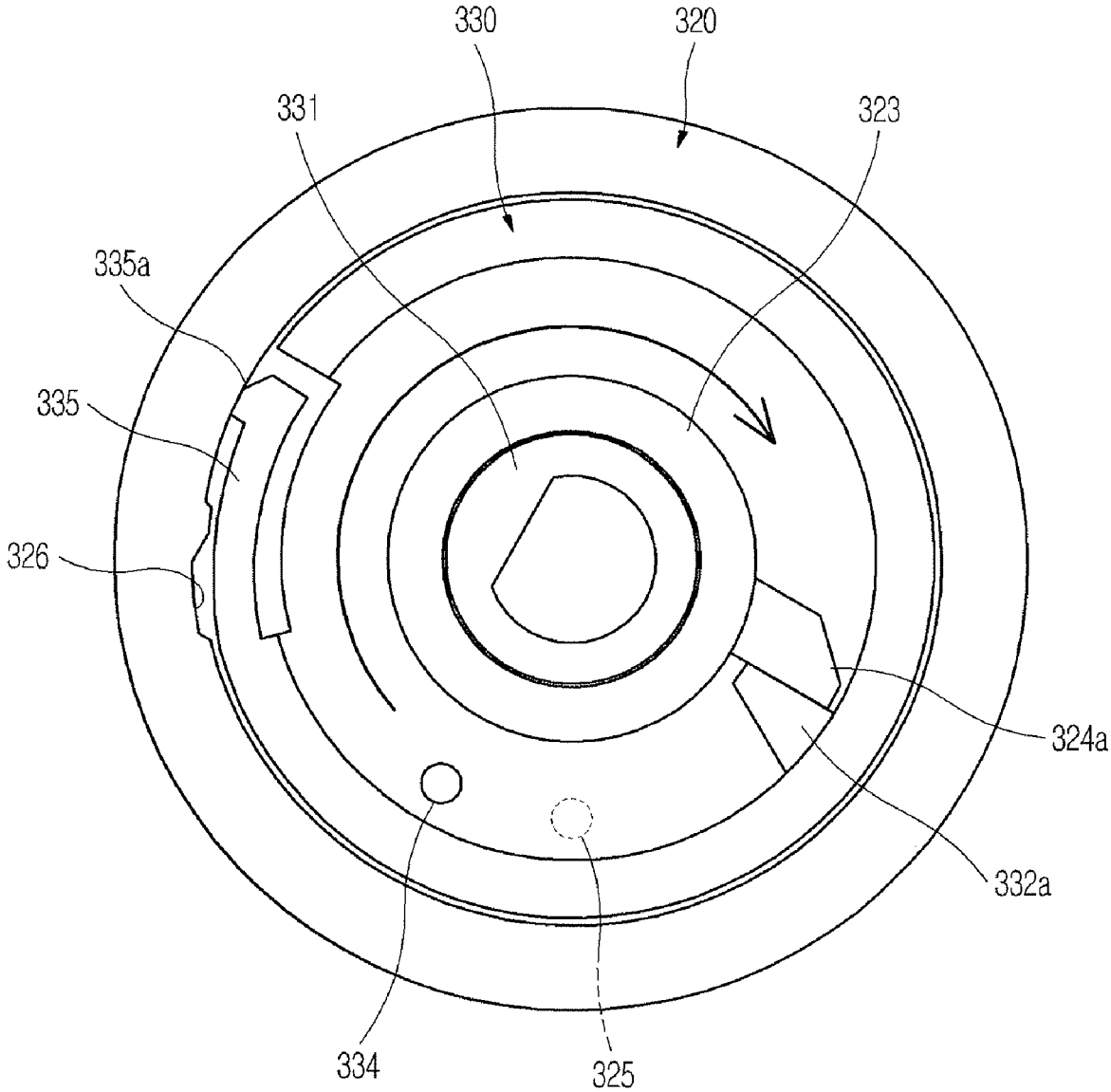
FIG. 7 is a view illustrating a positional relationship between a rotary member and a power transmission member after the power transmission member is rotated a predetermined angle from a state of FIG. 6 of an embodiment of the present general inventive concept.

Hereinafter, the developer stirring operation performed by the first stirring unit and the second stirring unit in the image forming apparatus according to an embodiment of the present general inventive concept will be described with reference to FIGS. 2 to 7. FIG. 7 is a view illustrating a positional relationship between the rotary member 330 and the power transmission member 320 after the power transmission member is rotated a predetermined angle from the state of FIG. 6.

Before the developer cartridge 200 is mounted in the image forming apparatus and initially driven, the power transmission member 320 and the rotary member 330 are coupled to each other as illustrated in FIG. 6. That is, the catching protrusion 324*a* of the power transmission member 320 and the interference protrusion 332*a* of the rotary member 330 are spaced apart from each other by a predetermined angle θ in the rotation direction of the power transmission member 320 (in the direction indicated by the arrow A).

In this state, when the developer cartridge 200 is mounted in the apparatus body 10, and the drive source 11 is energized, a rotary force is transmitted to the power transmission member 320 via the driving coupler 12 and the driven coupler 310.

With the rotation of the power transmission member 320, the power transmission gear 340, connected to the power transmission member 320 via the connection, rotates, with the result that the first stirring unit 220 is rotated to stir the developer in the developer storage chamber 210*a*.

At this time, the elastic piece 335 of the rotary member 330 is fitted in the coupling groove 326 of the power transmission member 320, and therefore, some of the rotary force is transmitted to the rotary member 330. However, a load applied to the second stirring unit 230 in the developer storage chamber 210*a* is greater than the rotary force, with the result that the rotary member 330 cannot be rotated along with the power transmission member 320. Consequently, as the power transmission member 320 is rotated, the elastic piece 335 of the rotary member 330 is elastically deformed, and therefore, the hook 335*a* is separated from the coupling groove 326. Furthermore, the catching protrusion 324*a* of the power transmission member 320 is spaced apart from the interference protrusion 332*a* of the rotary member 330 in the rotation direction. Consequently, the power transmission member 320 is idly rotated for a predetermined period of time although the power transmission member 320 is coupled to the rotary member 330.

After the power transmission member 320 is rotated by θ, as illustrated in FIG. 7, the interference protrusion 332*a* of the rotary member 330 interferes with the catching protrusion 324*a* of the power transmission member 320. As a result, the rotary force of the power transmission member 320 is transmitted to the rotary member 330, and therefore, the second stirring unit 230 is rotated along with the first stirring unit 220 to stir the developer in the developer storage chamber 210*a*. Consequently, the entire developer in the developer storage chamber 210*a* is stirred by the first stirring unit 220 and the second stirring unit 230 such that the developer can be efficiently supplied to the developer discharge portion 211.

According to an embodiment of the present general inventive concept, as described above, the second stirring unit 230 starts to be rotated after the developer lumping phenomenon is partially solved by the first stirring unit 220, which is primarily rotated, and therefore, preventing an excessive load from being applied to the first stirring unit 220 and the second stirring unit 230 due to simultaneous rotation of the first stirring unit 220 and the second stirring unit 230 is possible.

In the above description, the developer cartridge 200 is constructed in a structure in which the first stirring unit 220, which is disposed relatively near to the developer discharge portion 211, is primarily rotated. Alternatively, the developer cartridge 200 may be constructed in a structure in which the second stirring unit 230 is primarily rotated, and, after the lapse of a predetermined period of time, the first stirring unit 220 is rotated. However, the rotation of the stirring units generally accounts for a point of time when the developer will be supplied to the developing unit 100 approaches. Therefore, the first stirring unit 220, which is disposed near to the developer discharge portion 211, is primarily rotated to stir the developer around the first stirring unit 220 such that the developer is prepared to be supplied to the developer discharge portion 211.

Also, in the above description, the stirring process is performed by the two stirring units. Alternatively, three or more stirring units may be provided such that at least two of the stirring units are rotated with time delay, if a size of the developer storage chamber is large.

Also, when two or more stirring units are provided, a single drive source can be used considering reduction of expenses and simplification of the structure. Nevertheless, using two or more drive sources to appropriately control points of time when the respective stirring units are driven to accurately stir the developer or adjust the amount of developer supplied is possible. Generally, however, a total of n−1 drive sources, when a number of the stirring units is n can be used, considering the reduction of expenses and the simplification of the structure.

Also, in the above description, the developer cartridge is provided separately from the developing unit, and the stirring units are rotated in the developer cartridge with time delay. Alternatively, the developer cartridge and the developing unit may be integrated, and the stirring units may be mounted in the integrated cartridge. Primarily rotating the stirring unit near the developer discharge portion to efficiently stir and feed the developer is possible.

Figure 8:
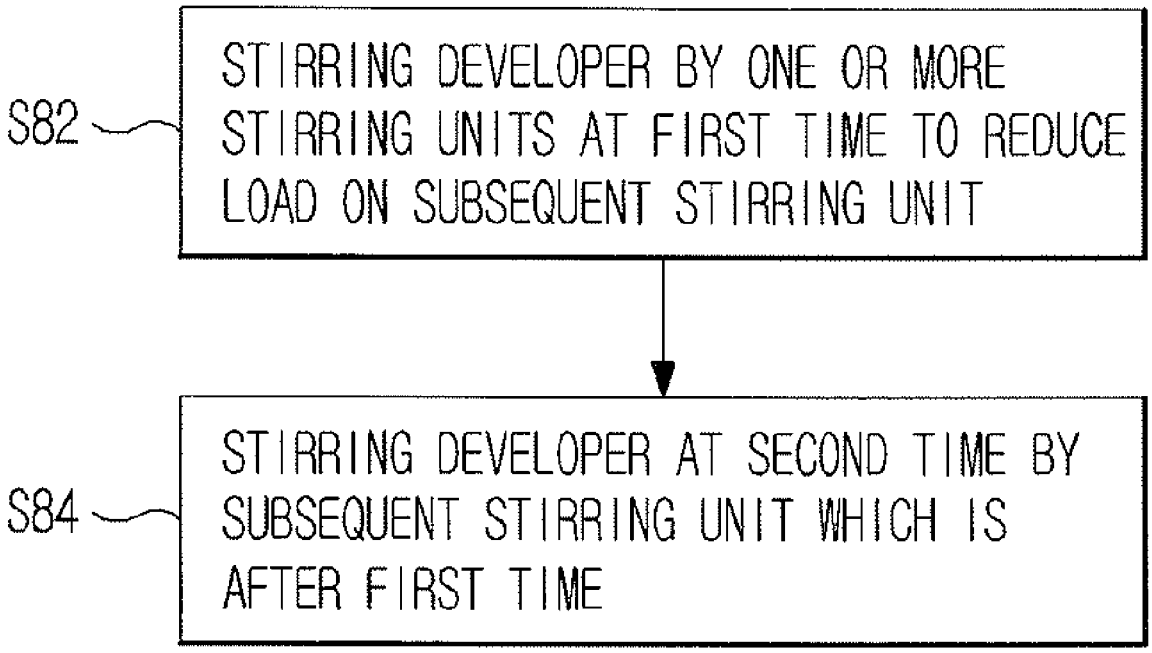
FIG. 8 is a flowchart illustrating a method of stirring developer in an image forming apparatus according to an embodiment of the present general inventive concept.

FIG. 8 is a flowchart illustrating a method of stirring developer in an image forming apparatus according to an embodiment of the present general inventive concept. Referring to FIGS. 2 and 8, in operation S82, developer is stirred by one or more stirring units 220 at a first time to reduce a load on a subsequent stirring unit 230. In operation S84, the developer is stirred at a second time by the subsequent stirring unit which is after the first time.

The present general inventive concept can also be embodied as computer-readable codes on a computer-readable medium. The computer-readable medium can include a computer-readable recording medium and a computer-readable transmission medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

As apparent from the above description, the stirring units, mounted in the developer storage chamber, are rotated with time delay to disperse the load applied to the stirring units to prevent damage to the stirring units, the drive source, and the members to interconnect the drive source and the stirring units due to overload.

Although various embodiments of the present general inventive concept have been illustrated and described, it would be appreciated by those skilled in the art that changes may be made in this embodiment without departing from the principles and spirit of the general inventive concept, the scope of which is defined in the claims and their equivalents.

What is claimed is:

1. A developer cartridge usable with an image forming apparatus, the developer cartridge comprising:

a housing having a developer storage chamber;

a first stirring unit rotatably mounted in the housing, the first stirring unit having a first rotary shaft;

a second stirring unit rotatably mounted in the housing, the second stirring unit having a second rotary shaft;

a rotary member coaxially coupled to the second rotary shaft of the second stirring unit to transmit a rotary force to the second stirring unit, the rotary member having an interference portion;

a power transmission member coaxially disposed on the second rotary shaft of the second stirring unit such that the power transmission member is rotatably coupled to the rotary member, the power transmission member having a gear portion formed at an outer circumference thereof and a catching portion located such that the interference portion of the rotary member interferes with the catching portion after a rotation of the power transmission member by a predetermined angle;

a connection gear disposed to engage with the gear portion of the power transmission member; and a power transmission gear disposed to engage with the connection gear, the power transmission gear being coaxially coupled to the first rotary shaft of the first stirring unit to transmit a rotary force to the first stirring unit, wherein a rotary force of the power transmission member is continuously transmitted to the first stirring unit via the connection gear and the power transmission gear, and the power transmission member transmits the rotary force to the second stirring unit at a point of time when the interference portion of the rotary member interferes with the catching portion of the power transmission member after an idling of the power transmission member relative to the rotary member for a predetermined time.

2. The developer cartridge according to claim 1, wherein the rotary member and the power transmission member have position locating portions to adjust relative positions between the rotary member and the power transmission member when the rotary member and the power transmission member are coupled to each other.

3. The developer cartridge according to claim 1, wherein the rotary member includes an elastic piece formed at one side of the edge thereof, and the power transmission member includes a coupling groove, in which the elastic piece is fitted.

4. The developer cartridge according to claim 1, wherein the developer storage chamber includes a developer discharge portion through which a developer is discharged, and the first stirring unit is disposed nearer to the developer discharge portion than the second stirring unit.

5. The developer cartridge according to claim 1, wherein the first stirring unit and the second stirring unit are driven by a single drive source.

6. A developing device usable with an image forming apparatus, the developing device comprising:

a developer storage chamber;

a first stirring unit and a second stirring unit to stir a developer in the developer storage chamber, the first stirring unit and the second stirring unit having a first rotary shaft and a second rotary shaft, respectively;

a rotary member coaxially coupled to the second rotary shaft of the second stirring unit to transmit a rotary force to the second stirring unit, the rotary, member having a receiving groove and an interference protrusion disposed in the receiving groove;

a power transmission member coaxially disposed on the second rotary shaft of the second stirring unit such that the power transmission member is rotatably coupled to the rotary member, the power transmission member having a gear portion formed at outer circumference thereof and a catching protrusion received in the receiving groove such that the interference protrusion of the rotary member interferes, with the catching protrusion after a rotation of the power transmission member by a predetermined angle;

a connection gear disposed to engage with the gear portion of the power transmission member; and a power transmission gear disposed to engage with the connection gear, the power transmission gear being coaxially coupled to the first rotary shaft of the first stirring unit to transmit a rotary force to the first stirring unit, wherein a rotary force of the power transmission member is continuously transmitted to the first stirring unit via the connection gear and the power transmission gear, and the power transmission member transmits the rotary force to the second stirring unit at a point of time when the interference protrusion of the rotary member interferes with the catching protrusion of the power transmission member after an idling of the power transmission member relative to the rotary member for a predetermined time.

7. The developing device according to claim 6, wherein the rotary member includes a first position locating hole, and the power transmission member includes a second position locating hole corresponding to the first position locating hole.

8. An image forming apparatus, comprising:

an apparatus body;

a developing unit mounted in the apparatus body, the developing, unit including a photoconductor and a development roller to supply a developer to the photoconductor; and a developer cartridge mounted in the apparatus body, such that the developer cartridge is replaceable separately from the developing unit, to store a developer to be supplied to the developing unit, the developer cartridge comprising:

a housing having a developer storage chamber;

a first stirring unit rotatably mounted in the housing, the first stirring unit having a first rotary shaft;

a second stirring unit rotatably mounted in the housing, the second stirring unit having a second rotary shaft;

a rotary member coaxially coupled to the second rotary shaft of the second stirring unit to transmit a rotary force to the second stirring unit, the rotary member having an interference portion;

a power transmission member coaxially disposed on the second rotary shaft of the second stirring unit such that the power transmission member is rotatably coupled to the rotary member, the power transmission member having a gear portion formed at an outer circumference thereof and a catching portion located such that the interference portion of the rotary member interferes with the catching portion a rotation of the power transmission member by a predetermined angle;

a connection gear disposed to engage with the gear portion of the power transmission member; and a power transmission gear disposed to engage with the connection gear, the power transmission gear being coaxially coupled to the rotary shaft of the first stirring unit to transmit a rotary force to the first stirring unit, wherein a rotary force of the power transmission member is continuously transmitted to the first stirring unit via the connection gear and the power transmission ear, and the power transmission member transmits the rotary force to the second stirring unit a point of time when the interference portion of the rotary member interferes with the ca portion of the power transmission member after an idling of the power transmission member relative to the rotary member for a predetermined time.

9. The image forming apparatus according to claim 8, wherein the rotary member includes a first position locating hole and an elastic piece having a hook, and the power transmission member includes a second position locating hole and a coupling groove, in which the hook of the elastic piece is fitted when the second position locating hole is aligned with the first position locating hole.

* * * * *